US010543946B2

(12) United States Patent
Borasi et al.

(10) Patent No.: US 10,543,946 B2
(45) Date of Patent: Jan. 28, 2020

(54) SHEET OF PACKAGING MATERIAL FOR PRODUCING A CONTAINER AND METHOD FOR PRODUCING CONTAINERS

(71) Applicant: TETRA LAVAL HOLDINGS & FINANCE S.A., Pully (CH)

(72) Inventors: Gabriele Borasi, Spilamberto (IT); Roberto Sgro', Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 356 days.

(21) Appl. No.: 15/311,363

(22) PCT Filed: May 5, 2015

(86) PCT No.: PCT/EP2015/059765
§ 371 (c)(1),
(2) Date: Nov. 15, 2016

(87) PCT Pub. No.: WO2015/173054
PCT Pub. Date: Nov. 19, 2015

(65) Prior Publication Data

US 2017/0073102 A1 Mar. 16, 2017

(30) Foreign Application Priority Data

May 16, 2014 (EP) ..... 14168560

(51) Int. Cl.
*B65B 61/18* (2006.01)
*B65D 5/74* (2006.01)
(Continued)

(52) U.S. Cl.
CPC ..... *B65B 61/18* (2013.01); *B65B 3/025* (2013.01); *B65B 7/28* (2013.01); *B65D 5/064* (2013.01);
(Continued)

(58) Field of Classification Search
CPC ..... B65B 31/18
(Continued)

(56) References Cited

U.S. PATENT DOCUMENTS 5,934,496 A 8/1999 Mogard et al.
2005/0173438 A1 8/2005 Berggren
(Continued)

FOREIGN PATENT DOCUMENTS

CN 1622877 A 6/2005
CN 102481998 A 5/2012
(Continued)

OTHER PUBLICATIONS

International Search Report (PCT/ISA/210) dated Jul. 31, 2015, by the European Patent Office as the International Searching Authority for International Application No. PCT/EP2015/059765.
(Continued)

*Primary Examiner* — Lori L Baker
(74) *Attorney, Agent, or Firm* — Buchanan Ingersoll & Rooney PC

(57) ABSTRACT

A sheet of packaging material to form a package, comprises a receiving region to receive an opening device of the package attached thereon, the sheet of packaging material further comprises two reference marks detectable by a detecting unit of an applying device arranged for applying the opening device on the receiving region. A method for producing a package comprises folding, filling and sealing a sheet of packaging material to obtain the package, the packaging material comprising a receiving region to receive an opening device and two reference marks, the method comprising detecting the reference marks and selecting a subsequent action to be performed on the package and/or the opening device on the basis of the detected position of the reference marks.

17 Claims, 5 Drawing Sheets

(51) Int. Cl.

| | |
|---|---|
| ***B65B 3/02*** | (2006.01) |
| ***B65D 5/06*** | (2006.01) |
| ***B65D 5/62*** | (2006.01) |
| ***B65B 7/28*** | (2006.01) |
| ***B65D 5/42*** | (2006.01) |
| ***B65D 77/40*** | (2006.01) |
| ***B65D 85/72*** | (2006.01) |
| ***B65D 85/80*** | (2006.01) |

(52) U.S. Cl.
CPC ..... *B65D 5/4266* (2013.01); *B65D 5/62* (2013.01); *B65D 5/746* (2013.01); *B65D 77/40* (2013.01); *B65D 85/72* (2013.01); *B65D 85/80* (2013.01)

(58) Field of Classification Search
USPC ..... 53/412
See application file for complete search history.

(56) References Cited

U.S. PATENT DOCUMENTS

| | | | |
|---|---|---|---|
| 2006/0236655 | A1 | 10/2006 | Cavilli et al. |
| 2012/0138634 | A1 | 6/2012 | Benkö et al. |
| 2013/0228614 | A1 | 9/2013 | Bergholtz |

FOREIGN PATENT DOCUMENTS

| | | | |
|---|---|---|---|
| EP | 1 215 123 | A1 | 6/2002 |
| EP | 1 462 370 | A1 | 9/2004 |
| EP | 2 287 082 | A1 | 2/2011 |
| JP | S63-274534 | A | 11/1988 |
| JP | 2002-284155 | A | 10/2002 |
| JP | 2013-502349 | A | 1/2013 |
| RU | 2183183 | C2 | 6/2002 |
| WO | WO 95/05996 | A1 | 3/1995 |

OTHER PUBLICATIONS

Office Action/Search Report dated Oct. 31, 2018, by the Russian Patent Office in corresponding Russian Patent Application No. 2016149339/12(079240) and an English Translation of the Office Action/Search Report. (12 pages).

Office Action (Notification of Reasons for Refusal) dated Jan. 8, 2019, by the Japanese Patent Office in corresponding Japanese Patent Application No. 2016-567356 and an English Translation of the Office Action. (12 pages).

Office Action (Communication pursuant to Article 94(3) EPC) dated Aug. 28, 2019, by the European Patent Office in corresponding European Patent Application No. 14 168 560.2-1016. (5 pages).

SHEET OF PACKAGING MATERIAL FOR PRODUCING A CONTAINER AND METHOD FOR PRODUCING CONTAINERS

TECHNICAL FIELD

The present invention refers to a sheet of packaging material for producing a container. The present invention also refers to a method for producing containers, in particular containers provided with an opening device.

BACKGROUND OF INVENTION

As is known, many pourable food products, such as fruit juice, UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated strip packaging material. The packaging material has a multilayer structure comprising a base layer for stiffness and strength, which may comprise a layer of fibrous material, e.g. paper, or of mineral-filled polypropylene material, and which is covered on both sides with layers of thermoplastic material, e.g. polyethylene film. In the case of aseptic packages for long-storage products, such as UHT milk, the packaging material comprises a layer of oxygen-barrier material, e.g. aluminium foil, which is superimposed on a layer of thermoplastic material, and is in turn covered with another layer of thermoplastic material forming the inner face of the package eventually contacting the food product.

Packages of this sort are produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating; and the web of packaging material so sterilized is maintained in a closed, sterile environment, and is folded and sealed longitudinally to form a vertical tube.

The tube is filled with the sterilized or sterile-processed food product, and is sealed and subsequently cut along equally spaced cross sections to form pillow packs, which are then folded mechanically to form respective finished, e.g. substantially parallelepiped-shaped, packages.

Alternatively, the packaging material may be cut into blanks, which are formed into packages on forming spindles, and the packages are filled with the food product and sealed. One example of this type of package is the so-called "gable-top" package known by the trade name Tetra Rex (registered trademark).

Once formed, the above packages may undergo further processing, such as the application of an opening device to enable the product to be poured out.

At present, the most commonly marketed opening devices comprise a frame portion defining a pour opening and fitted about a removable or pierceable portion of a top wall of the package; and a cap hinged or screwed to the frame portion, and which is removable to open the package.

In particular, each opening device may be applied to a corresponding so-called "prelaminated" hole of the packaging material, i.e. a hole formed in the base layer only and covered by the other lamination layers, including the layer of gas-barrier material.

Applying units for applying opening devices to packages are known in which the packages are advanced by a conveying unit, for example a conveyor belt defining a substantially horizontal plane and supporting the packages. The applying units further comprise an applying device having applying elements that receives an opening device from a delivery unit, advance the opening device through a gluing unit, in which a layer of glue is distributed on the frame portion of the opening device, and then apply the opening device to a wall, in particular to a top wall, of the package.

The applying units further comprise a sensor device, for example a camera, which detects the position of the packages, in particular of the "prelaminated" holes, and generates a signal which controls the applying elements.

A drawback of the known applying units is that the opening device may be improperly applied to the package. In particular, in case the package is not aligned with the applying element—for instance in case the package is tilted on the conveyor belt—the opening device is not arranged in the right position, for example is not centered on the "prelaminated" hole. In this way, the final package may be defective.

In case the mutual misalignment of the package and the applying element is even bigger, the applying unit may not be able at all to apply the opening device on the package.

DISCLOSURE OF INVENTION

An object of the present invention is to improve the application of opening devices to packages.

Another object of the invention is to prevent production of defective packages, having an opening device that is not correctly applied thereon.

According to a first aspect of the present invention, there is provided a sheet of packaging material as claimed in claim 1.

According to a second aspect of the present invention, there is provided a method for producing a package as claimed in claim 11.

BRIEF DESCRIPTION OF THE DRAWINGS

A preferred, non-limiting embodiment of the present invention will be described by way of example with reference to the accompanying drawings, in which.

DETAILED DESCRIPTION OF PREFERRED EMBODIMENTS

Figure 1:
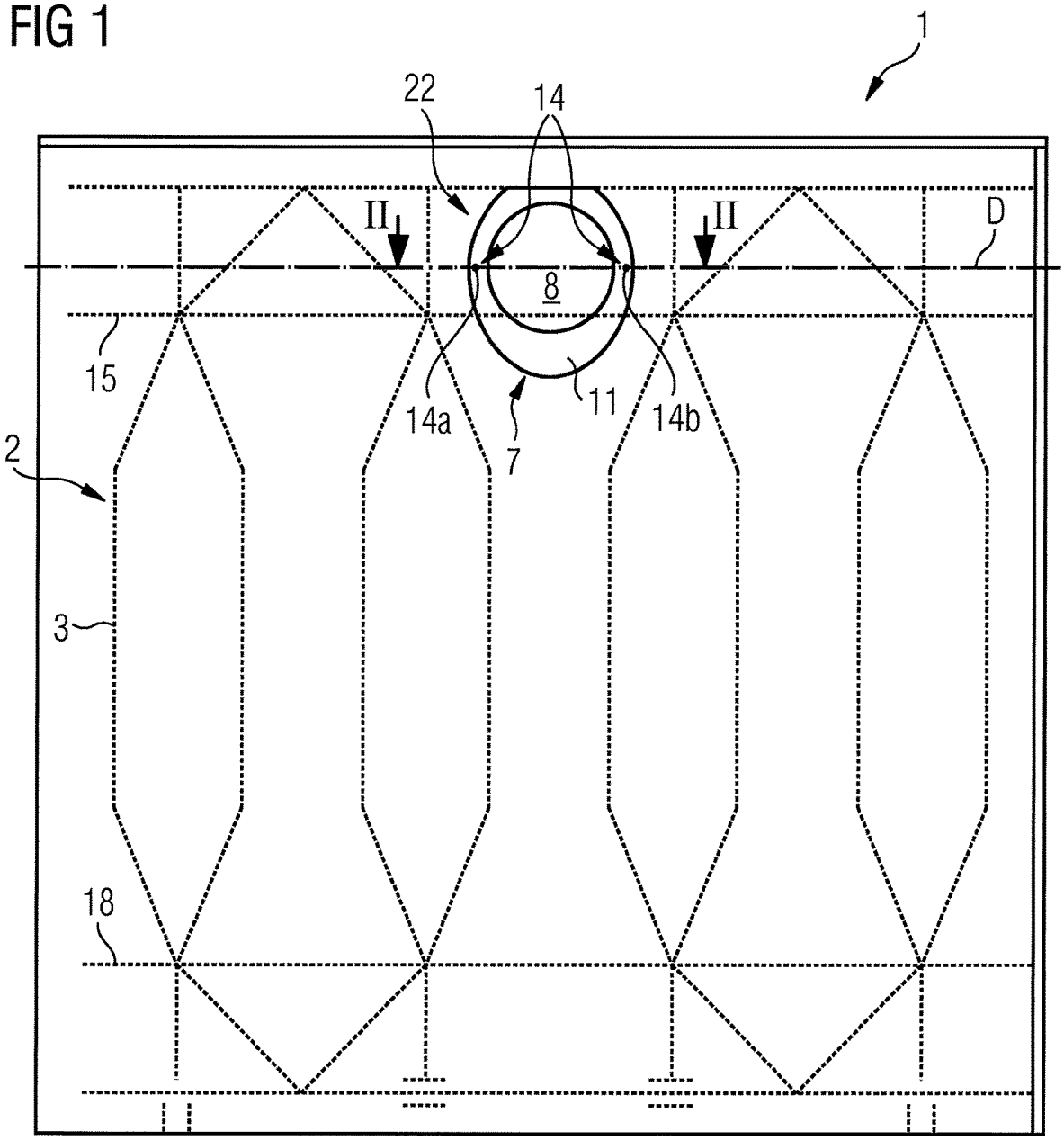
FIG. 1 is a plan view of a sheet of packaging material according to the invention.
Figure 3:
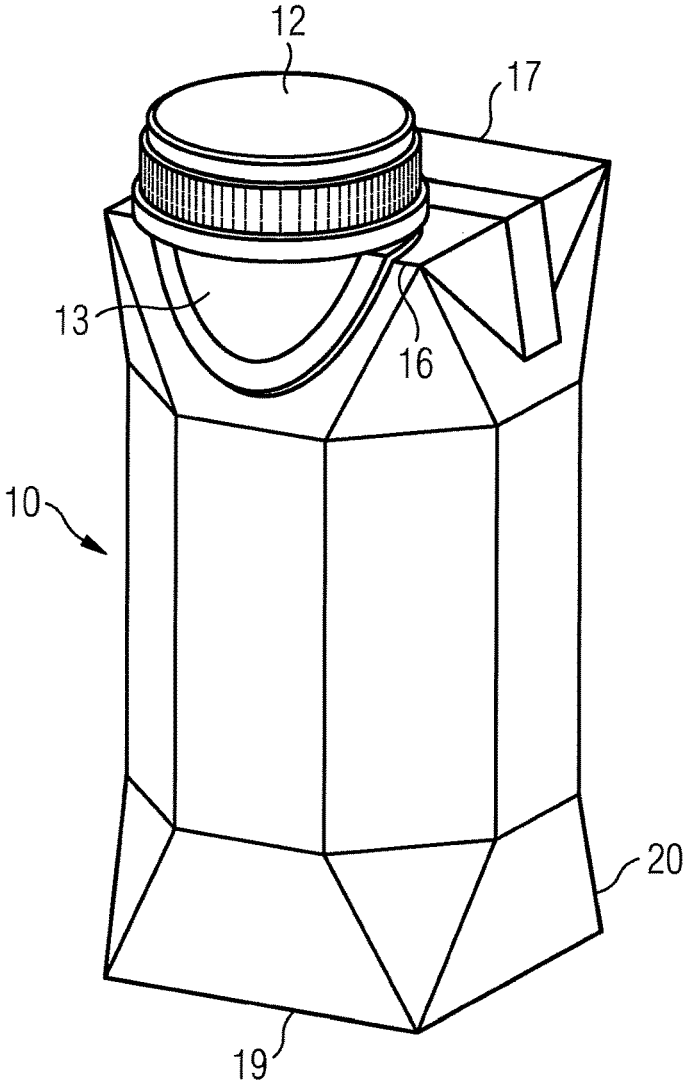
FIG. 3, is a perspective view of a package obtained from the sheet of packaging material of FIG. 1.

FIG. 1 shows a sheet of packaging material 1 comprising a creasing pattern 2, i.e. a number of creasing lines 3 obtained during manufacturing of the sheet of packaging material 1 and defining preferential folding lines along which the sheet of packaging material 1 is folded to form a package 10 (shown in FIG. 3).

In particular, FIG. 1 shows a unit of packaging material intended to form a package 10. This unit can be a portion of a packaging material web, or strip, comprising a plurality of units arranged one after the other, i.e. in a line, along a longitudinal dimension of the web, or strip. The web, or strip, may have the shape of a reel which is unwounded, formed into a tube, filled, sealed and cut into individual packages in a packaging machine.

As an alternative, the unit may have the shape of a single blank which is folded, filled and sealed to obtain a corresponding package.

The following description and the claims apply to both the reel-type (i.e. web, or strip) packaging material and the blank-type packaging material.

Figure 2:
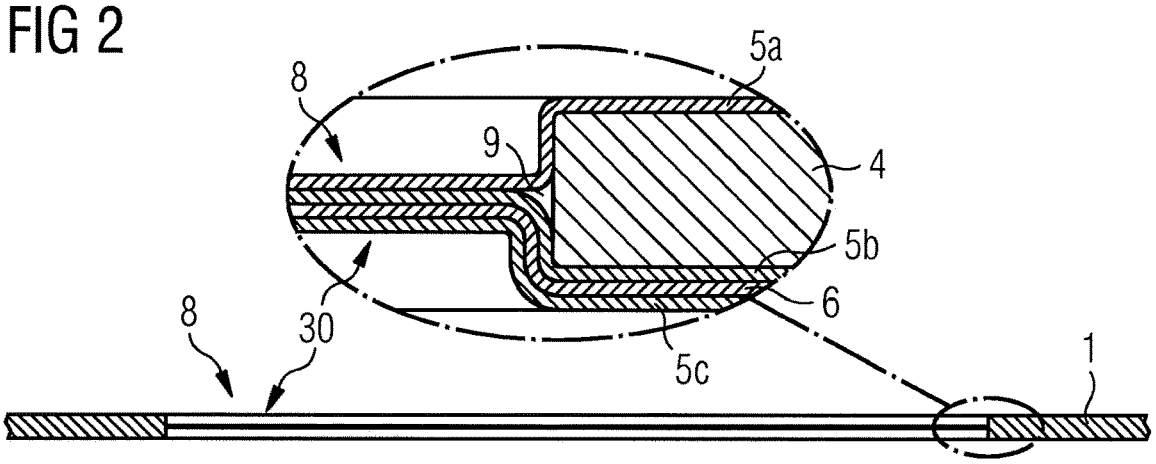
FIG. 2 is a section II-II of the sheet of packaging material of FIG. 1.

As shown in FIG. 2, the packaging material 1 comprises a base layer 4 for stiffness and strength, which may be made of fibrous material, e.g. paper, or mineral-filled polypropylene material, and a first covering layer 5*a* and a second covering layer 5*b*, made of heat-sealable plastic material, e.g. polyethylene films, and covering both sides of base layer 4.

In the case of an aseptic container for long-storage products, such as UHT milk, the sheet of packaging material 1 also comprises a barrier layer 6 made of gas-barrier material, e.g. aluminium foil or ethyl vinyl alcohol (EVOH) film, which is superimposed on the second covering layer 5*b* and is in turn covered with a third covering layer 5*c*, made of heat-sealable plastic material, e.g. a polyethylene film, forming the inner face of the package 10 eventually contacting the food product.

In other words, the first covering layer 5*a*, the second covering layer 5*b*, the barrier layer 6 and the third covering layer 5*c* define lamination layers applied to the base layer 4 when producing the sheet of packaging material 1.

The creasing lines 3 may be obtained by punching, so as to create indentations, or embossments, in the base layer 4, the indentations, or embossments, being subsequently covered by the above-mentioned lamination layers.

The sheet of packaging material 1 also comprises a receiving region 7 intended to receive an opening device (shown in FIG. 3), which allows pouring of the product contained in the package 10.

As shown in FIG. 2, the receiving region 7 comprises a breakable portion 8, for example a so-called pre-laminated hole, i.e. a hole (or opening) 9 formed through the base layer 4 of the sheet of packaging material 1 and covered by the above-mentioned lamination layers, so that the hole 9 is sealed by a respective sheet cover portion 30.

The receiving region 7 further comprises a border portion 11 surrounding the breakable portion 8. The border portion defines an applying portion for the opening device 12. The opening device 12 comprises a frame 13 arranged to be fixed, for example glued, or heat sealed, to the border portion 11 and a cutter (not shown) arranged to pierce the cover portion 30, i.e. the breakable portion 8, when the package 10 is opened for the first time. Opening devices of this kind are known and therefore not disclosed in detail, not being part of the present invention.

In an alternative embodiment not shown, the breakable portion may even be defined by only one or some of the above-mentioned lamination layers. For example, the breakable portion may be made solely of gas-barrier material.

In another alternative embodiment not shown, the breakable portion may be defined by a patch fixed to the rest of the sheet of packaging material to seal a hole formed, in this case, through the full thickness of the sheet of packaging material.

The sheet of packaging material 1 further comprises two reference marks 14 detectable by a detecting unit 23 (FIGS. 5 and 6) of an applying device 24 (FIGS. 5 and 6) arranged for applying the opening device 12 on the receiving region 7. In one embodiment, the detecting unit 23 comprises a camera.

The two reference marks 14 comprise a first reference mark 14*a* and a second reference mark 14*b* which define a direction D.

As shown in FIGS. 1 and 2, direction D is parallel to a first creasing line 15 defining a top front edge 16 and a top rear edge 17 of the package 10.

Similarly, direction D is parallel to a second creasing line 18 defining a bottom front edge 19 and a bottom rear edge 20 of the package 10.

In general the first reference mark 14*a* and the second reference mark 14*b* are disposed in a pre-determined position with respect to the creasing pattern 2. In particular, the first reference mark 14*a* and the second reference mark 14*b* are arranged in such a way that direction D is aligned with at least some of the creasing lines 3.

As shown in FIG. 1, the first reference mark 14*a* and the second reference mark 14*b* are arranged on opposite sides of the receiving region 7.

The reference marks 14 may be obtained in different ways on the sheet of packaging material sheet.

For example, the reference marks 14 may be printed on the base layer 4, during manufacturing of the sheet of packaging material 1, and subsequently covered with the first covering layer 5*a*. In this case, the first covering layer 5*a* is made of a transparent material.

As an alternative, the reference marks 14 may be printed on the sheet of packaging material 1 once the sheet of packaging material 1 has been manufactured. In this case, the reference marks are printed on the first covering layer 5*a*.

As a further alternative, the reference marks 14 may be of other types, such as magnetic reference marks detectable by a magnetic sensor.

The sheet of packaging material 1 usually comprises printings, for instance images or portion of text connected with the product to be packaged into the package 10.

The reference marks 14 are, in this case, aligned with the printings.

As shown in FIG. 1, the reference marks 14 are obtained in the receiving region 7, in particular in the border portion 11.

The receiving region 7 has a different appearance with respect to a zone 22 of the sheet of packaging material 1 arranged outside of the receiving region 7.

The sheet of packaging material 1—as disclosed above—may comprise printings in the zone 22 arranged outside of the receiving region 7. In this case, the border portion 11 is an unprinted area of the sheet of packaging material 1 and the reference marks 14 are placed in the border portion 11. In particular, the wording "unprinted area" means that the above-mentioned images or portion of text connected with the product to be packaged are not printed in the border portion 10.

In particular, the border portion 10 has a different appearance with respect to the breakable zone 8 and the zone 22 of the sheet of packaging material 1 arranged outside of the receiving region 7.

Figure 5:
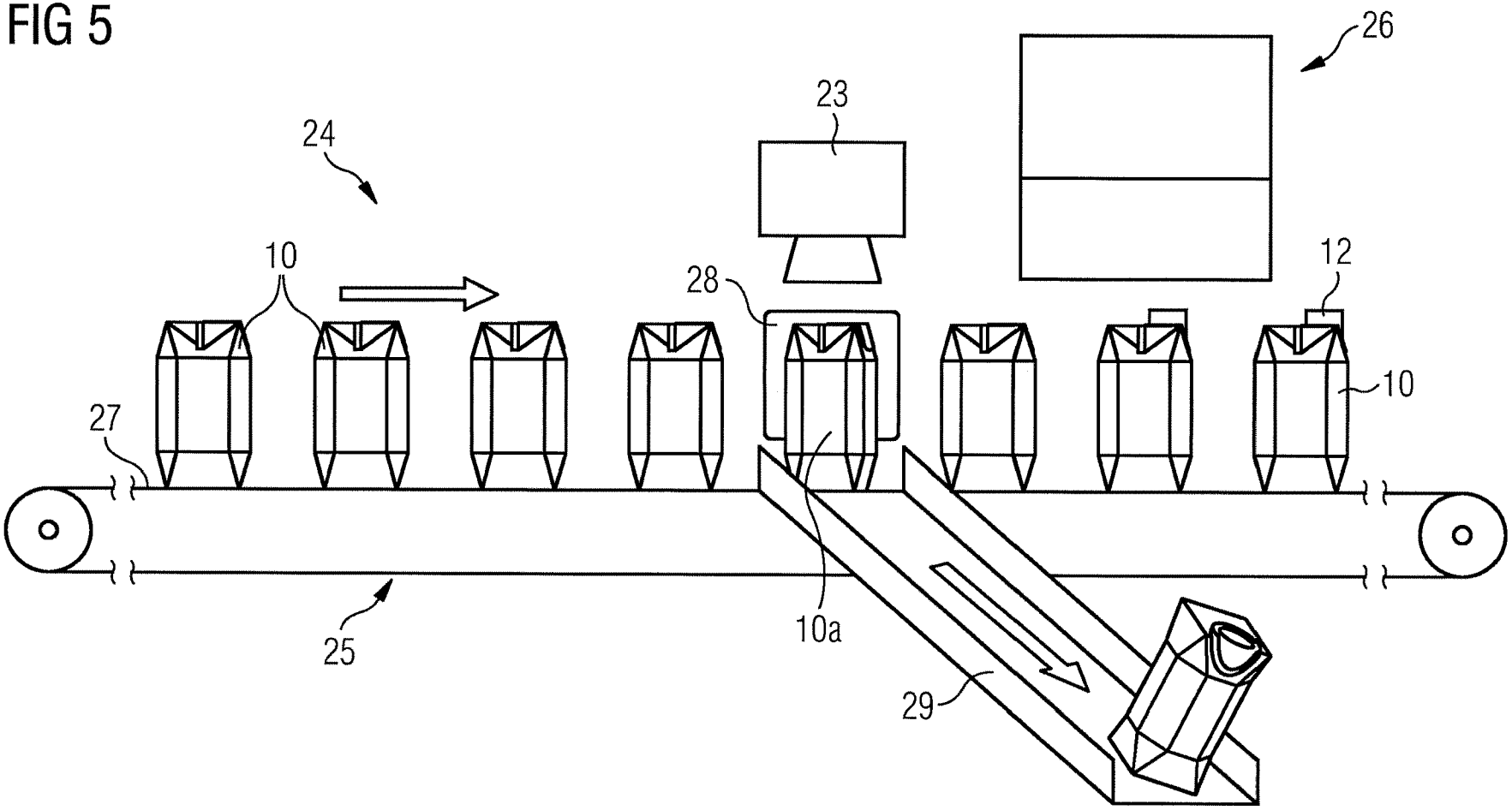
FIG. 5 is schematic side view showing an apparatus for producing a package from the sheet of packaging material of FIG. 1.
Figure 6:
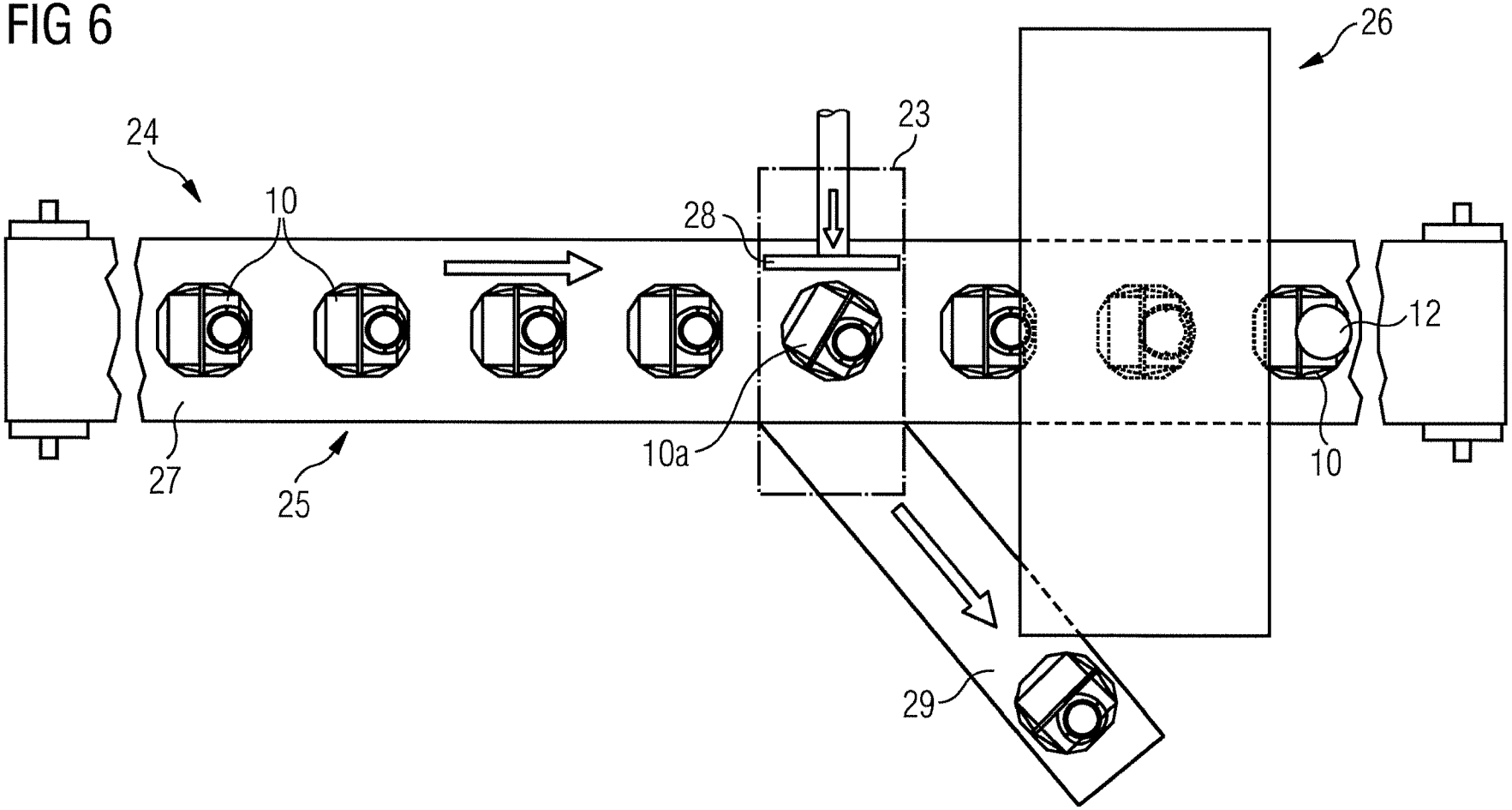
FIG. 6 is a schematic top view of the apparatus of FIG. 5.

With reference to FIGS. 5 and 6, there is shown an applying device 24 for applying an opening device 12 to a package 10.

The applying device 24 comprises a conveying device 25, for example a conveyor belt 27, and an applying unit 26. The applying unit 26 comprises a plurality of applying elements (not shown), each applying element being arranged to receive an opening device 12 from a delivering unit (not shown), to advance the opening 12 device through a glue distribution unit (not shown), in which a layer of glue is applied to the frame 13 of the opening device 12, and to apply the opening device 12 to a respective package 10 advanced by the conveying device 25.

The applying unit 26 further comprises a detecting unit 23 arranged to detect the reference marks 14 so as to determine the position of the package 10.

In particular, the detecting unit 23 detects the first reference mark 14*a* and the second reference mark 14*b* and, therefore, the direction D defined by the first reference mark 14*a* and the second reference mark 14*b*. Subsequently, the detecting unit 23 compares the orientation of the detected direction D with the orientation of a reference direction R.

In case the detected direction D corresponds to the reference direction R, the detecting unit 23 sends a control signal to the applying unit 26 so that the applying element applies the opening device 12 to the package 10.

Figure 4:
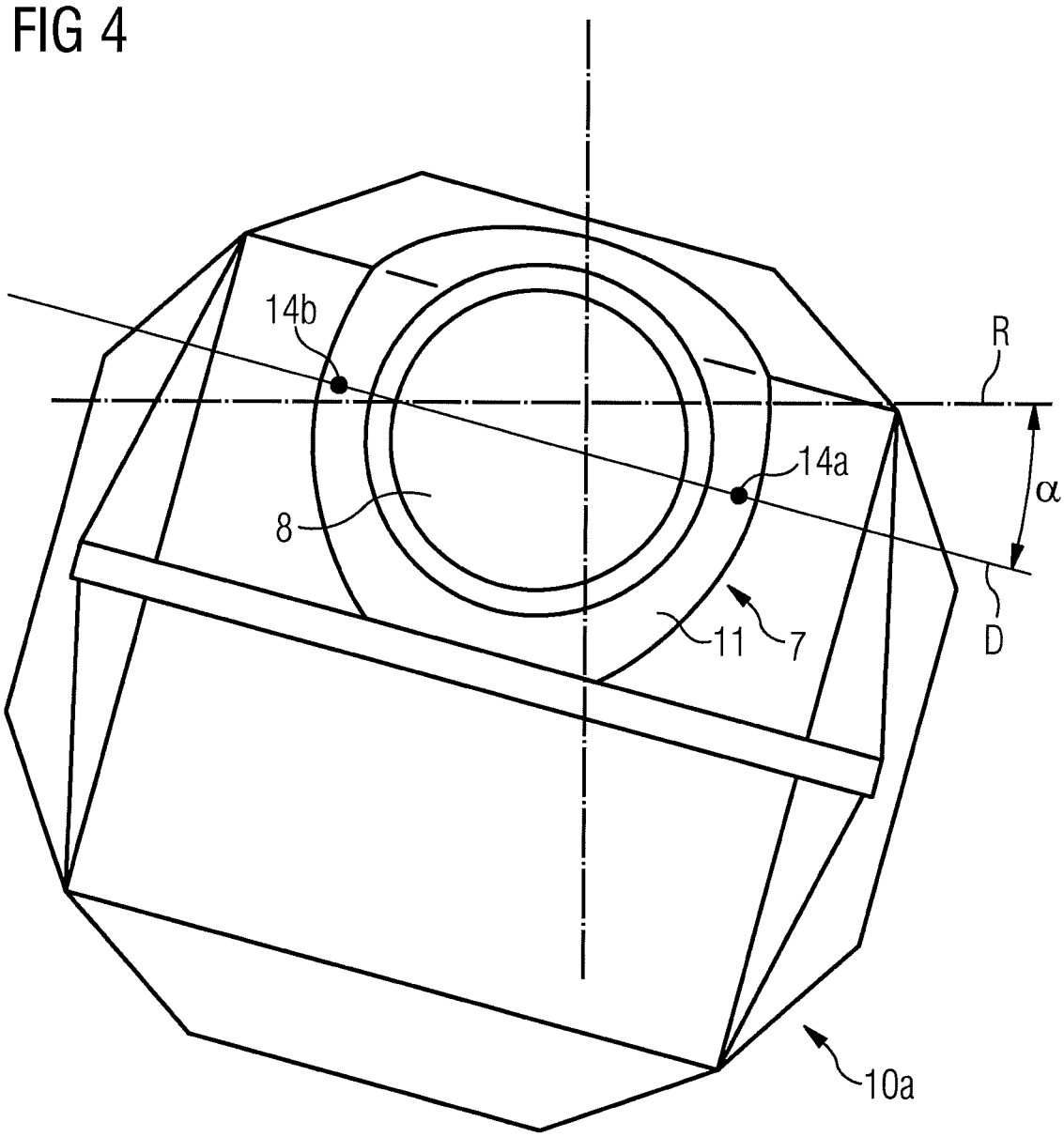
FIG. 4 is plan view of a package obtained from the sheet of packaging material of FIG. 1, the package being tilted with respect to a reference position.

In case the detected direction D does not correspond to the reference direction R—for example if a package 10*a* is tilted with respect to the conveyor belt 27 (as shown in FIGS. 5 and 6) and the detected direction D forms an angle $\alpha$ with the reference direction R (as shown in FIG. 4)—a plurality of different actions can be taken.

According to a first embodiment, the detecting unit 23 sends a control signal to a discarding unit 28 that discards the package 10*a* and conveys the package 10*a* to a waste conveyor 29.

According to a second embodiment, the detecting unit 23 sends a control signal to a positioning device—not shown—that moves the package 10*a* with respect to the conveying device 25 until the direction D corresponds to the reference direction R. Subsequently, the applying element applies the opening device 12 to the package 10*a*.

According to a third embodiment, the detecting unit 23 sends a control signal to a moving device—not shown—that moves the applying element with respect to the package 10*a* until the direction D corresponds to the reference direction R. Subsequently, the applying element applies the opening device 12 to the package 10*a*.

According to a fourth embodiment, the detecting unit 23 generates an alarm system for an operator.

Owing to the sheet of packaging material and to the method according to the invention it is possible to improve the application of opening devices to packages.

By detecting the reference marks 14, in fact, it is possible to check if the package is in the correct position before applying the opening device. In this way, it is possible to avoid production of defective packages, in which the opening device is applied in an incorrect position, and production of packages lacking the opening device at all.

Since the first reference mark 14*a* and the second reference mark 14*b* define direction D—the orientation of which is compared with the orientation of the reference direction R—a very simple and effective detection system is obtained.

In addition, in case the receiving region has a different appearance with respect to a zone of the packaging material arranged outside of the receiving region and the reference marks are arranged in the receiving region, the reference marks may be detected very easily and precisely. In the image generated by the detecting unit, in fact, the reference marks clearly stand out from the background. This is particularly applicable in case the reference marks are placed in the border portion, the border portion is an unprinted area of the sheet of packaging material and the zone of the packaging material arranged outside of the receiving region, i.e. outside of the border portion, is a printed area.

Clearly, changes may be made to the sheet of packaging material 1 and the method for producing containers described herein without, however, departing from the scope of protection as defined in the accompanying claims.

The invention claimed is:

1. A sheet of packaging material configured for folding, filling with a product and sealing so as to form a package, the sheet of packaging material comprising; a receiving region configured for receiving an openable opening device of said package attached thereon to allow the product in the package to be dispensed when the opening device is opened, said sheet of packaging material further comprising two reference marks detectable by a detecting unit of an applying device arranged for applying said opening device on said receiving region to permit determination whether the package is in a correct position before applying the opening device.

2. A sheet of packaging material according to claim 1, wherein said two reference marks are arranged on opposite sides of said receiving region.

3. A sheet of packaging material according to claim 1, wherein said receiving region has a different appearance with respect to a zone of said sheet of packaging material arranged outside of said receiving region, said reference marks being arranged in said receiving region.

4. A sheet of packaging material according to claim 1, wherein said receiving region comprises a border portion and a breakable portion, said border portion surrounding said breakable portion, said reference marks being arranged in said border portion.

5. A sheet of packaging material according to claim 4, wherein said border portion is an unprinted area of said sheet of packaging material.

6. A sheet of packaging material according to claim 5, wherein said border portion is surrounded by a printed area of said sheet of packaging material.

7. A sheet of packaging material according to claim 4, and further comprising at least a first layer and a second layer, and having a hole formed through said first layer and sealed by a cover portion of said second layer, said breakable portion comprising said cover portion.

8. A sheet of packaging material according to claim 7, wherein said breakable portion comprises an aluminium layer covered, on the side intended to form the outside of said package, by a transparent plastic layer.

9. A sheet of packaging material according to claim 1, and further comprising a plurality of creasing lines, said creasing lines being intended to promote folding of said sheet of packaging material to form said package, said reference marks defining a direction that is aligned with at least one of said creasing lines.

10. A sheet of packaging material according to claim 1, and further comprising a printed zone, said reference marks defining a direction that is aligned with said printed zone.

11. A sheet of packaging material to be folded, filled with a product and sealed to form a package, the sheet of packaging material comprising:

a base layer of fibrous material provided with a through hole, the base layer possessing opposite sides;

plastic layers each positioned one of the sides of the base layer, the plastic layers covering the though hole in the base later to define a pre-laminated hole;

a border portion surrounding the pre-laminated hole;

the border portion and the pre-laminated hole together defining a receiving region configured to receive an opening device applied by an applying device to allow the product in the package to be dispensed; and the receiving region including two spaced-apart camera-readable reference marks which can be read by a camera of the applying device to determine an orientation of the package.

12. The sheet of packaging material according to claim 11, wherein the sheet of packaging material includes a plurality of spaced apart crease lines along which the packaging material is folded, the two spaced-apart camera-readable reference marks being arranged so that a straight line connecting the two spaced-apart camera-readable reference marks is parallel to several of the crease lines.

13. The sheet of packaging material according to claim 11, wherein the two spaced-apart camera-readable reference marks are provided on the border portion of the packaging material at a position outwardly of the pre-laminated hole so that a straight line connecting the two spaced-apart camera-readable reference marks passes through the pre-laminated hole.

14. The sheet of packaging material according to claim 1, wherein the sheet of packaging material includes a plurality of spaced apart crease lines along which the packaging material is folded, the two reference marks that are detectable by the detecting unit of the applying device being arranged so that a straight line connecting the two reference marks is parallel to several of the crease lines.

15. A sheet of packaging material configured for folding, filling with a product and sealing to form a package, the sheet of packaging material comprising; a receiving region configured for receiving an openable opening device to allow the product in the package to be dispensed when the opening device is opened, a part of the sheet of packaging material defining a reference direction, the sheet of packaging material further comprising two reference marks together defining a direction detectable by a detecting unit of an applying device that is arranged for applying the opening device on the receiving region and that compares an orientation of the detected direction to an orientation of the reference direction to determine whether the package is in a correct position before applying the opening device.

16. The sheet of packaging material according to claim 1, wherein the part of the sheet of packaging material defining the reference direction is a crease line along which the packaging material is folded during the folding of the packaging material.

17. The sheet of packaging material according to claim 1, wherein the part of the sheet of packaging material defining the reference direction is a crease line along which the packaging material is folded during the folding of the packaging material, a straight line passing through the two reference marks constituting the direction that is detectable by the detecting unit, the detecting unit determining that the package is in the correct position when the straight line and the crease line are parallel.

* * * * *